US005803660A

United States Patent [19]

Warren et al.

[11] Patent Number: 5,803,660

[45] Date of Patent: Sep. 8, 1998

[54] INTEGRATED REEF BUILDING SYSTEM

[76] Inventors: Donald J. Warren, 10437 Heritage Farm Rd., Lake Worth, Fla. 33467; Daniel T. Warren, 3940 NW. 83 La., Coral Springs, Fla. 33077

[21] Appl. No.: 631,415

[22] Filed: Apr. 12, 1996

[51] Int. Cl.[6] ..... F02B 3/00; H01K 61/00

[52] U.S. Cl. ..... 405/25; 405/21; 405/30; 119/221

[58] Field of Search ..... 405/15–21, 24, 405/25, 29–35, 284, 286; 119/221, 222

[56] References Cited

U.S. PATENT DOCUMENTS

| | | | |
|---|---|---|---|
| 2,653,450 | 9/1953 | Fort | 405/287 |
| 2,892,340 | 6/1959 | Fort . | |
| 3,220,141 | 11/1965 | Goss, III | 46/25 |
| 4,316,431 | 2/1982 | Kimura | 119/3 |
| 4,840,516 | 6/1989 | Rambo | 405/33 |
| 4,896,996 | 1/1990 | Mouton et al. | 405/21 |
| 4,997,311 | 3/1991 | Van Doren | 405/30 |
| 5,071,285 | 12/1991 | Van Doren | 405/25 |
| 5,122,015 | 6/1992 | Shen | 405/284 |
| 5,215,406 | 6/1993 | Hudson | 405/21 X |

*Primary Examiner*—Dennis L. Taylor
*Attorney, Agent, or Firm*—Oltman, Flynn & Kubler

[57] ABSTRACT

Artificial reef structures include various building components that are performed from concrete and the like. The components include square blocks having mounting grooves on the upper and lower surfaces. The blocks can include a center base plate, a circular opening instead of a center base plate, or be completely hollow. Optional metal bolts can be threaded through the center base plate. A hollowed out dome structure component includes through-holes and triangular type side openings. An arch component includes ribs separated and connected together by perpendicular rectangular beams. All the structure components can be used separately by themselves, in identical groups or in combination with one another either stacked or interlocked. For example, the blocks can be interlocked together with two blocks side by side and connected together by at least a third block on a second level. The domes can be fit over the blocks. The arch component can be positioned over the blocks as well. Still another configuration is combining all the blocks, the dome and arch together. The artificial reef structure provides an environment where colored growth such as coral, sea fan and the like can thrive. Furthermore, the openings in the reef structure can allow fish and other sea-life to be able to pass through. Further, the artificial reef structures can be positioned to be a protective barrier between natural offshore reefs and a shoreline.

10 Claims, 4 Drawing Sheets

INTEGRATED REEF BUILDING SYSTEM

This invention relates to an integrated reef building system. More particularly, the invention encompasses underwater building block structures with stackable and interlocking components that can be used as artificial reefs.

BACKGROUND AND PRIOR ART

The design and installation of patch reefs is of particular importance in areas where native reefs are on the decline from over exploitation (overuse) and in those areas suffering from storm damage, dredging damage, and pollution. Those conditions apply in southern Florida and in all developed coastal regions with either warm or cold water, and salt or fresh water.

A natural reef in Broward County, Fla. lies parallel to the shore in three belts. The first reef lies in shallow water and takes punishment from several areas. Years of dredging, that is removal of sand located between the first reef and the second reef and depositing this sand on the shore, creates a back wash of sand drifting back towards its original site, scouring and covering the first reef as it passes over. Thus, the first natural shore reef belt is being damaged over time.

Broward County's first belt reef is a mecca for sport divers and snorkelers. Because of concentration, Florida's best shore dive is heavily trafficked. This human contact often results in damage to the natural reef. Divers and snorkelers as a group are generally environmentally aware. However, many times the environmental awareness and the physical dive skills of this group are not equal. For example, snorkelers and divers sometimes stand on a shallow reef to rest. While standing, the snorkelers and divers grab on to the reefs themselves to steady themselves. The result of the grabbing causes unintentional damage to the reefs. An artificial reef extending parallel to shore between the first reef and shore would catch the first wave of human contact, provide needed additional habitat, attract colorful fish for tourists to enjoy, reduce sand loss, protect the first natural reef, concentrate snorkelers in clear view and access for lifeguard supervision and safety, enhance the already well known shore access dives and snorkelers site.

Economic impact studies of Dade County artificial reefs states that a very conservative economic impact of each artificial reef in Dade County is in excess of $120,000 dollars annually.

Recently, large structures such as ships have been sunk to create artificial reefs. However, serious damage to these artificial ship reefs have occurred off the coast in Broward County, following Hurricane Andrew and Tropical Storm Gordon. Replacing these large ship type structures can be time consuming as well as quite expensive.

Further problems have occurred as a result of the commercial shipping traffic off the mainland coasts. Commercial freighter grounding, such as the recent grounding of the Atria and others has damaged many areas of natural reef.

Thus, the need exists for building an artificial reef that avoids the problems of the prior art.

SUMMARY OF THE INVENTION

The first objective of the present invention is to provide artificial reefs for targeting specific habitats, species and underwater applications.

The second object of this invention is to provide an artificial reef having a versatile construction design for stability.

The third object of this invention is to provide an artificial reef which allows for expansion of an artificial reef system as budgeting and deployment constraints dictate.

The fourth object of this invention is to provide adaptable patterns with various covers for the creation of an artificial patch reef on barren sand, thus sustaining a foundation for a completely integrated oasis or virtual complete miniature ecological system.

The fifth object of this invention is to provide artificial reefs with versatile architectural design in order to enhance tourist and diver attractions.

The sixth object of this invention is to create sturdy artificial reef environments in which to train beginning divers on proper dive and snorkel protocol so as to preserve the ecological system of the reef.

The seventh objective of this invention is to create underwater species specific habitats to repopulate vanishing species by making predator protected environments including human predation.

The eighth objective of this invention is to form module (s) as artificial reefs to serve as a dive buoys so that boats do not damage the natural reef with their anchors. This module buoy would benefit the reef because most modern buoys are attached to natural reefs by drill holes and, also, anchor chains then encounter the natural reef where these modules could be positioned away from specific reef sites.

This invention is an integrated reef building system. This system allows for the underwater construction of a series of design and application specific artificial reefs. The bases for the reef design are independent interlocking blocks which may be arranged in a pattern to target a specific habitat, specific species or a specific application.

One unique characteristic is the versatility in potential construction designs. Blocks interlock to provide stability. Where applicable blocks may be bolted together, and further include shock absorbing spacers located between the interlocking components in combination with interlocking and bolting patterns. Individual components (blocks) can be securely connected to provide underwater stability yet, by their free-floating nature, some movement, in the form of tidal surge settling or shifting sands is tolerated. The completed structure(s) gain stability as a result of the play (movement) of each individual component.

The blocks (components) are stackable and remain interlocking in a stacked configuration. This stackability allows for expansion of the artificial reef system as budgeting and deployment constraints may dictate.

In marine environments such as the Gulf of Mexico where shifting sands tend to cover artificial reefs over time, this particular artificial reef can be expanded by adding more blocks (components). Pre addition areas would remain as the buried foundation for future building.

One free standing single block (component) creates viable habitat for fish and a growth substratum for the attachment of marine plant or animal life. Stacking and interlocking more components expands the habitat.

Water can flow easily around and through the novel artificial reef due to the unique honey-comb effect caused by stacking the interlocking components. Sunlight also penetrates most of the exposed surface areas.

The blocks can be used individually or stacked. In either configuration, the blocks can create a suitable base for the attachment of a myriad of differently designed covers which may be inset securely on the individual blocks. The adaptability of possible patterns and variety of covers (caps)

allows for the creation of an artificial patch reef on barren sand. This novel artificial reef will sustain a foundation for a completely integrated oasis, a virtual complete miniature ecological system.

Our novel artificial reef invention slows the sand as it is washed back from a shoreline. Our artificial reef provides a base which a natural growth of native marine life can take "root."

Each configuration of block(s) is expandable without interfering with the initial application. The surface of the modules, as a result of mold design, features exposed aggregate surface. This aggregate surface creates an ideal substratum for the attachment of marine plants and animals.

Many artificial reefs are designed to attract large fish where they may be more easily fished the particular design of this invention is to create a habitat for marine plants and animals. This habitat can develop into a self-sustaining eco-system which enhances to overall marine environment. Deep water components can be assembled on the surface and deployed in very deep water. Lobster production, for example, in an area could be increased by the improvement of habitat using our novel artificial reef. The limitation of habitat effects both warm and cold water species. Over predication by protected species, such as seals and otters, could be mitigated by the design and construction of fish friendly habitats that restrict access by predator mammals. The aqua culture of live rocks, base components create ideal platforms for culture of live rocks, lobster, abalone, edible oysters, cultured oysters, mussels, marine plants (kelp) algae, clams to name a few would be enhanced with the specific application of configuring these construction units (modules) in a design most suited to the specific species.

Any marine research department, university, county, and the like has need of a secure underwater laboratory to attach their specific marine study. Our novel modules can be assembled to provide a work bench, staging area, stable platform to protect an underwater study. The dive attractions of reef, walls, and the like can be accomplished by configuring the modules to suit the application and by attaching an indefinite number of precast insertable architectural components.

Each module or group of our novel artificial reef can serve as a dive buoy so that boats do not damage the natural reef with their anchors. This buoy would benefit the reef because most modern buoys are attached to natural reefs by drill holes. In addition, a buoy chain often drags around at the natural reef site. Our invention allows for suitable buoys to be established off the reef, in specific sites. Buoy sites could be moved periodically to reduce traffic damage.

Weights of individual bases used in the blocks can be adjusted by size and thickness of platform at top. Interlocking design will help reduce movement of artificial reef in hurricane conditions. This design is inherently more stable than a ship.

The design of this base exposes a large surface area that will settle into the bottom and provide additional stability. The design is eye pleasing and because the interchangeable component can be arranged to suit the builder, an infinite variety of architectural shapes can be created. This allows for variable types of underwater architecture.

The natural attachment of coral colonies on artificial reefs is well documented. Our novel artificial reef components provide an excellent substratum for the attachment of coral and other species. In addition, each component of our invention can include a number of built-in threaded inserts that can take concrete, fiber, plastic type bolts. Either or both the threaded inserts and the bolts can allow for the secure attachment of cultured coral and other organisms such as kelp, oyster, mussel, sponge, and the like. The culture of coral and other organisms is a viable aqua culture business in many areas of the country. Our invention provides the needed foundation for the selective seeding of an artificial reef. The inherent stability of this design makes it an excellent breakwater useful in areas of coastal erosion. It creates habitat and breakwater, more suitable than loose rocks or boulders. Our design allows for pilings to be added where applicable.

Our novel blocks also make excellent anchors for deep water floating fish aggregating devices (FAD). Kelp beds can be expanded by the attachment of kelp to the treaded plugs and subsequent colonization of kelp to the artificial reef. (Kelp requires hard bottom to attach securely). Areas currently consisting of sand, gravel or silt could support kelp habitat by utilizing our invention.

Diver attractions of unlimited description can be created by our invention. Underwater structures with swim through habitats for marine tropical and other species can be integrated into the system. Educational snorkel "trails" can be established with the use of these modules. Identification plates can be attached to the modules. Specific marine life cultures can be attached to educate and entertain tourist and locals to enhance the economic impact of the shore area.

Development of these artificial reef structures can help the environment and improve local tourist and fishing industries.

Further objects and advantages of this invention will be apparent from the following detailed description of a presently preferred embodiment which is illustrated schematically in the accompanying drawings.

BRIEF DESCRIPTION OF THE FIGURES

FIG. 11 is a partial view of a third type block and.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 2:
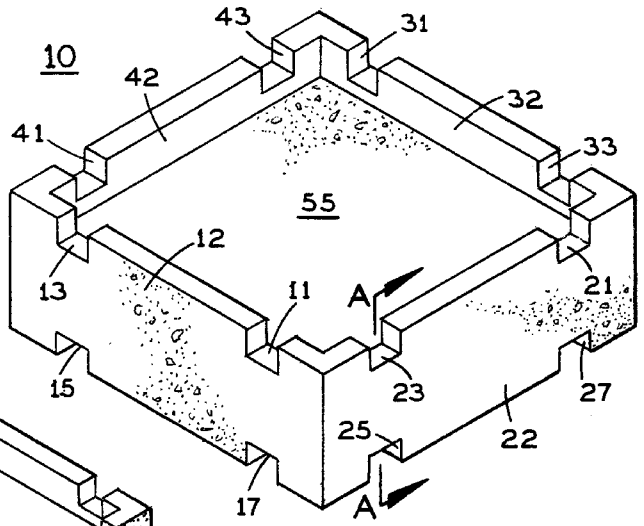
FIG. 2 is a perspective view of a first block used in the embodiment of FIG. 1.
Figure 3:
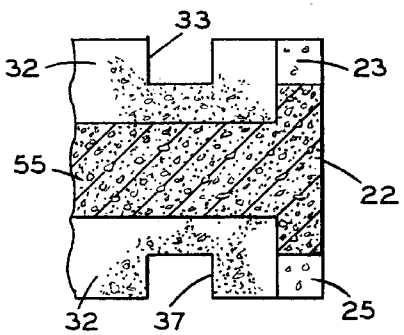
FIG. 3 is a cross-sectional view of a section of FIG. 2 along arrow A.
Figure 1:
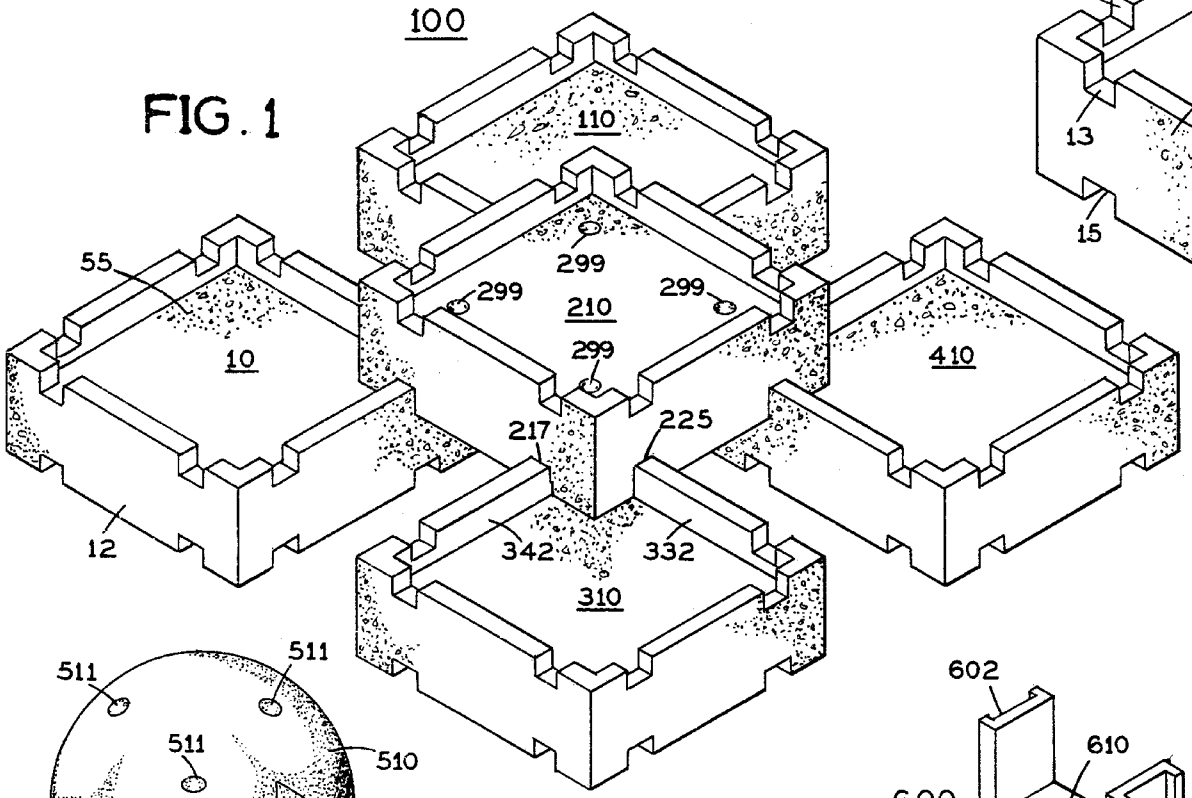
FIG. 1 is a perspective view of a preferred embodiment stacking building blocks into a structure.

FIG. 1 is a perspective view of a preferred embodiment 100 of stacking building blocks into a structure. FIG. 2 is a perspective view of a first block 10 used in the embodiment 100 of FIG. 1. FIG. 3 is a cross-sectional view of a section of block 10 of FIG. 2 along arrow A. Referring to FIGS. 1–3, building block 10 includes a square type block shape having four side walls 12, 22, 32, 42 with a center base plate 55 therebetween. Each side wall has four respective cut-out side grooves. Side wall 12 has groove cut-outs 11, 13, 15, and 17. Side wall 22 has groove cut-outs 21, 23, 25, and 27. Side wall 32 has groove cut-outs 31, 33, 35, and 37. Side wall 42 has groove cut-outs 41, 43, 45, and 47. Block 10 can be formed from concrete using conventional wood type forms. Alternatively, block 10 can be formed of other materials such as but not limited to plastic, fiberglass, and the like. The dimensions of block 10 can include sides of from several feet in length to ten feet or more in length.

Figure 4:
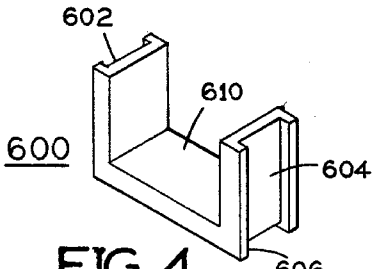
FIG. 4 is a perspective view of a rubber mount support used with the block structure of FIG. 1.

FIG. 4 is a perspective view of a rubber mount support 600 used with the block structure 100 of FIG. 1. Indented edges 602, 604, and 606 can fit into any of the groove cut-outs 21, 23, 31, 33 and the like of block 10 and the groove cut-outs of respective blocks 110, 210, 310, and 410. Metal bolts 299 such as but not limited to stainless steel, galvanized steel and the like can be used to secure blocks 110, 210, 310 and 410 to one another as shown in FIG. 1. Upper receptacle portion 610 can receive a sidewall of another block mounted above. Rubber mount support 600 can act as a shock absorber between two or more blocks and also allow the blocks to be more tightly fitted together.

Figure 5:
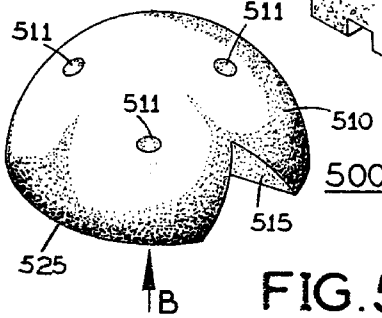
FIG. 5 is a perspective view of a dome used with the block(s) of FIGS. 1–2.
Figure 6:
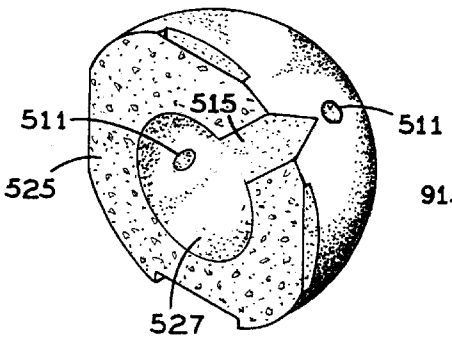
FIG. 6 is a side view of the dome of FIG. 5 along arrow B.

FIG. 5 is a perspective view of a dome 500 used with the block(s) of FIGS. 1–2. FIG. 6 is a side view of the dome 500 of FIG. 5 along arrow B. Referring to FIGS. 5–6, dome 500 can be concrete formed and include through-holes 511 passing external to the dome 500 to a hollowed out space 527 cut into base 525. The outer dome wall 510 can be semi-circular and additionally have triangular type side cut-out opening(s) 515.

Figure 7:
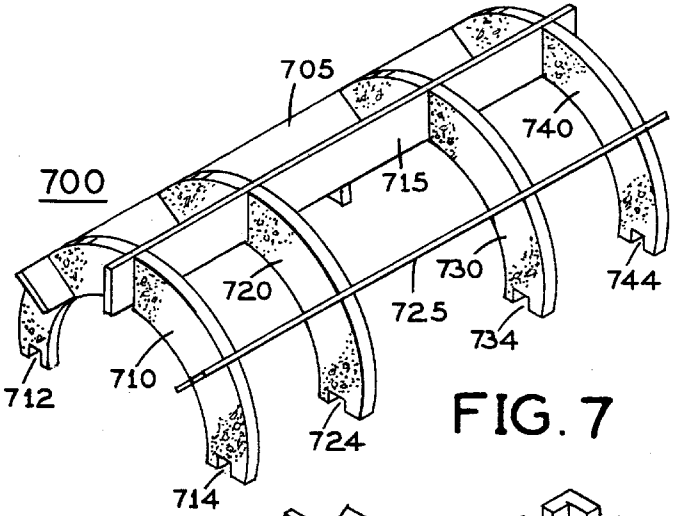
FIG. 7 is a perspective view of an arch structure for use with building an artificial reef.

FIG. 7 is a perspective view of an arch structure 700 for use with the blocks 10 and configuration 100 used in building an artificial reef. Arch 700 includes semi-circular ribs 710, 720, 730 and 740 that are connected together by rectangular connectors 705, 715 and 725. Each of the ribs has grooved openings 712, 714, 722, 724, 732, 734, and 744. Like the block(s) 10 of FIG. 2 and the dome 500 of FIG. 5, the arch 300 can be formed by preformed concrete and the like.

Figure 8:
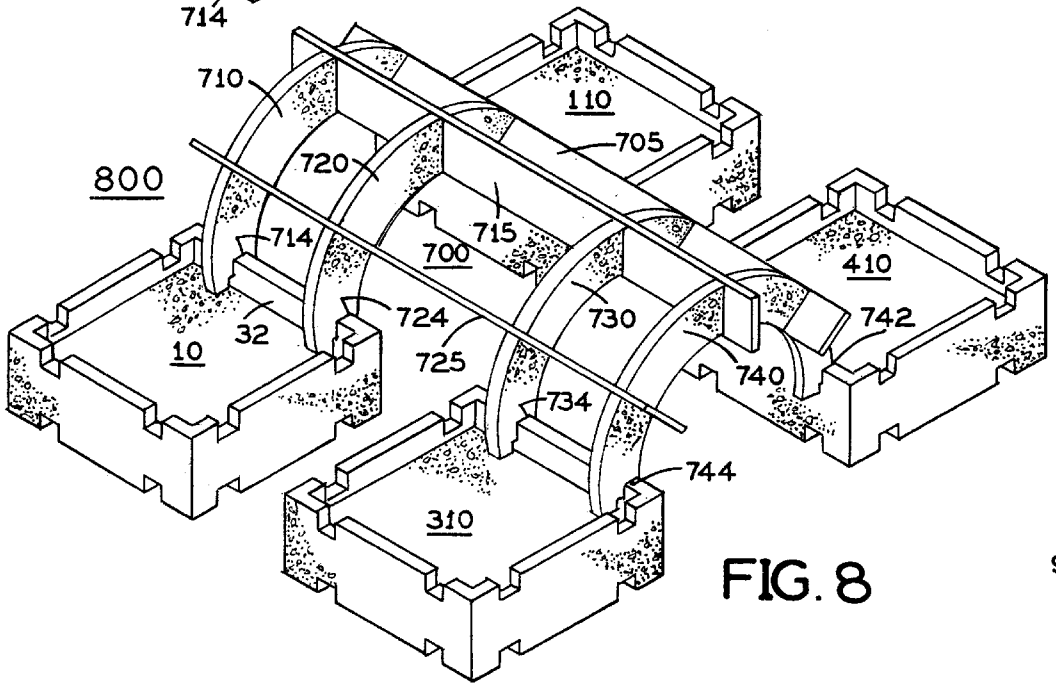
FIG. 8 is another embodiment of plural blocks and the arch structure of FIG. 7.

FIG. 8 is another embodiment 800 of plural blocks and the arch structure of FIG. 7. The groove openings 714 and 724 of the ribs 710 and 720 fit about the side-walls 32 and 332, of blocks 10 and 310, respectively. Likewise, blocks 110 and 410 are connected to the ribs in a similar manner.

Figure 9:
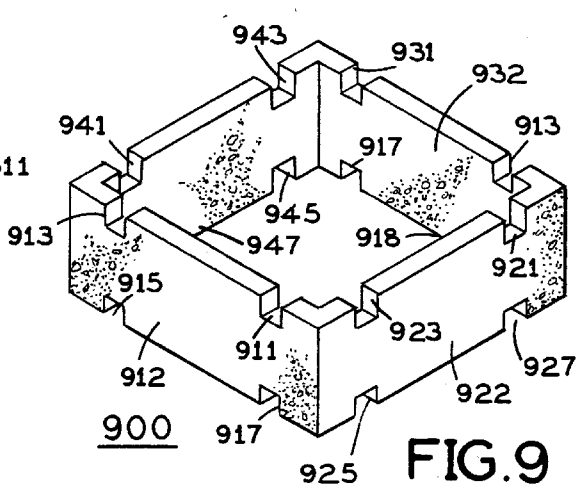
FIG. 9 is a perspective view of a second building block for use with the structures.

FIG. 9 is a perspective view of a second building block 900 for use with the artificial reef structures. Block 900 is similar to block 10 of FIG. 2 with the exception of not having a center base plate. Referring to FIG. 9, block 900 includes a square type block shape having four side walls 912, 922, 932, 942. Each side wall has four respective cut-out side grooves. Side wall 912 has groove cut-outs 911, 913, 915, and 917. Side wall 922 has groove cut-outs 921, 923, 925, and 927. Side wall 932 has groove cut-outs 931, 933, 935, and 937. Side wall 942 has groove cut-outs 941, 943, 945, and 947.

Figure 10:
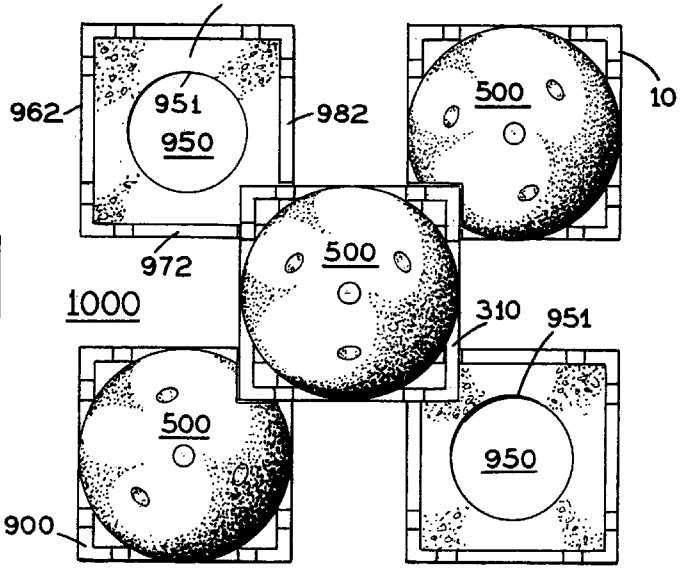
FIG. 10 is a top view of another preferred embodiment of the blocks and domes.

FIG. 10 is a top view of another preferred embodiment structure configuration 1000 which includes another block component 950 similar to 10 and 900 above but with a circular through-hole 951 in the center base plate 952. Configuration 1000 includes dome(s) 500 over blocks 10, 310 and 900, where block 310 interlocks all the blocks similar to the configuration of FIG. 1

Figure 11:
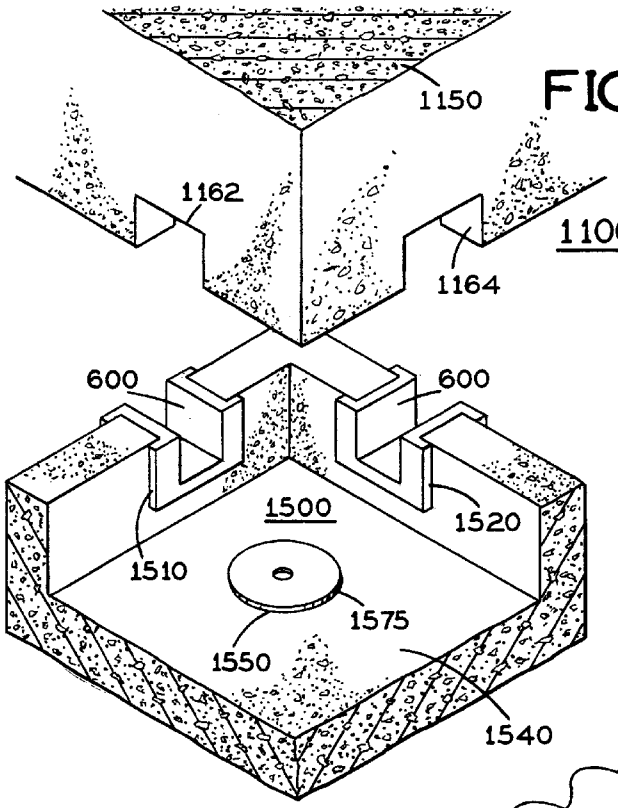

FIG. 11 is a partial view of a third type block 1100 which is similar to the blocks referred above with the exception of having a solid top end 1150 and only bottom grooves 1162, and 1164.

Figure 13:
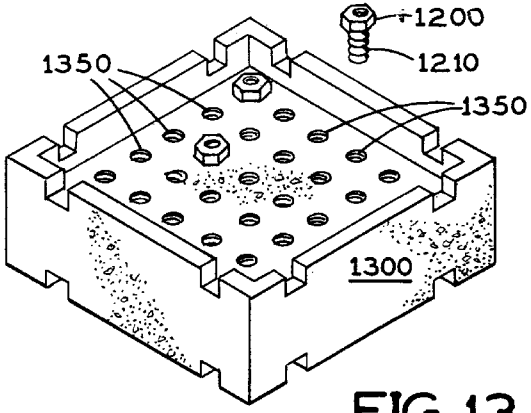
FIG. 13 is a perspective view of a fourth block with openings for the bolt(s) of FIG. 12.
Figure 12:
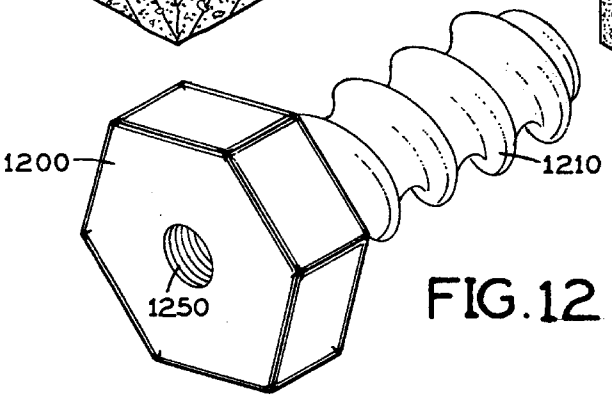
FIG. 12 is a perspective view of a bolt used in another embodiment.

FIG. 12 is a perspective view of a metal type bolt 1200 used in another embodiment 1300. FIG. 13 is a perspective view of a fourth block 1300 with openings 1350 for receiving the threaded ends 1210 the bolt(s) 1200 of FIG. 12. Bolt 1200 can optionally include a through-hole 1250 extending therethrough. In underwater environments, the metal bolt 1200 can provide for the growth of sea fan on the exposed surface. If coral can grow on the remaining surfaces areas of the block 1300, then the result would be different colors that would be visible to divers and snorkelers.

Figure 14:
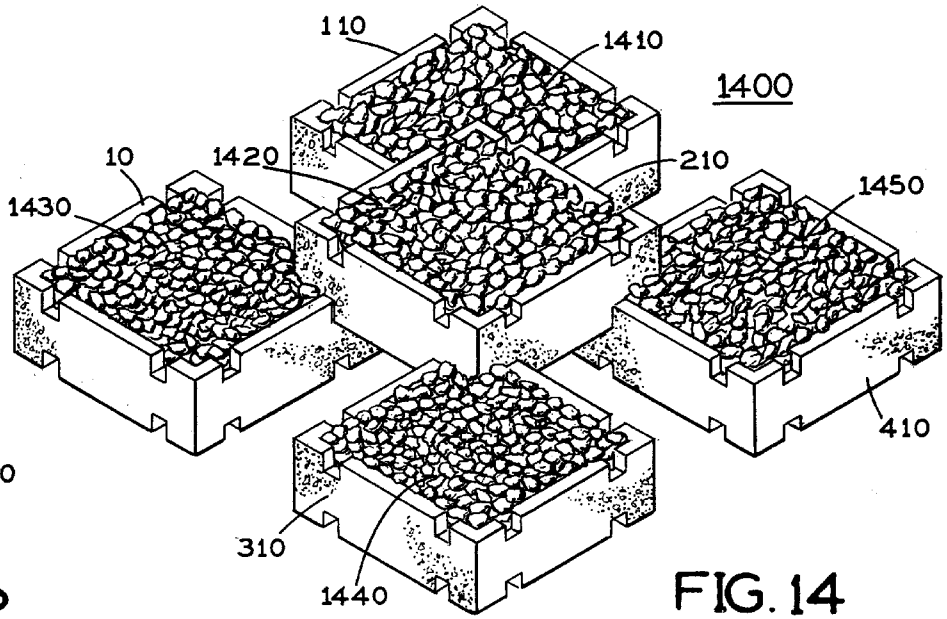
FIG. 14 is a perspective view of another preferred embodiment stacked blocks with gravel inserted.

FIG. 14 is a perspective view of another preferred embodiment configuration that includes interlocking blocks 10, 110, 210, 310 and 410 of FIG. 1 with gravel 1410, 1420, 1430 and 1440, inserted into the cavity portions above each block's respective center base plate.

Figure 15:
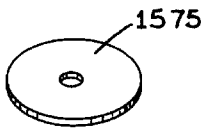
FIG. 15 is a sectional close-up view of a section of FIG. 13.

FIG. 15 is a sectional view of another block 1500 that can include a rubber washer 1575 that fits within an opening 1550 in the center base plate 1540 of the block. A metal bolt such as the one depicted as 299 in FIG. 1, can be inserted here. In FIG. 15, rubber support mounts 600 of FIG. 4 are inserted into the side-wall grooves 1510 and 1520, respectively.

Figure 19:
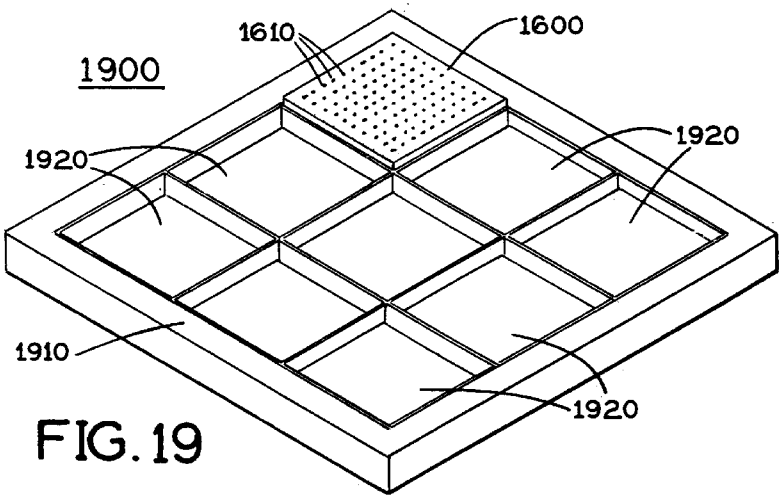
FIG. 19 is a perspective view of a center base plate that can receive the tray of FIG. 16.
Figure 17:
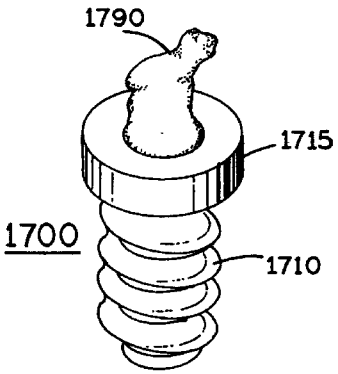
FIG. 17 is a perspective view of a mini-threaded insert for use with the mini-tray of FIG. 16.
Figure 18:
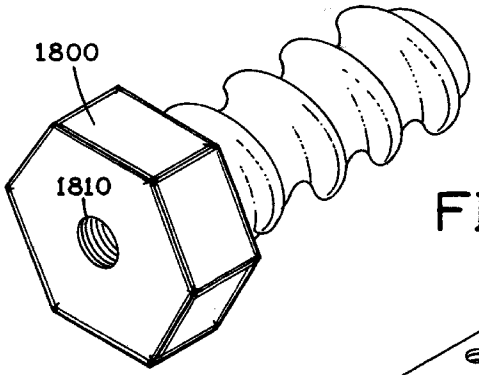
FIG. 18 is a version of the bolt of FIG. 12 with a threaded insert to receive the mini-insert of FIG. 17
Figure 16:
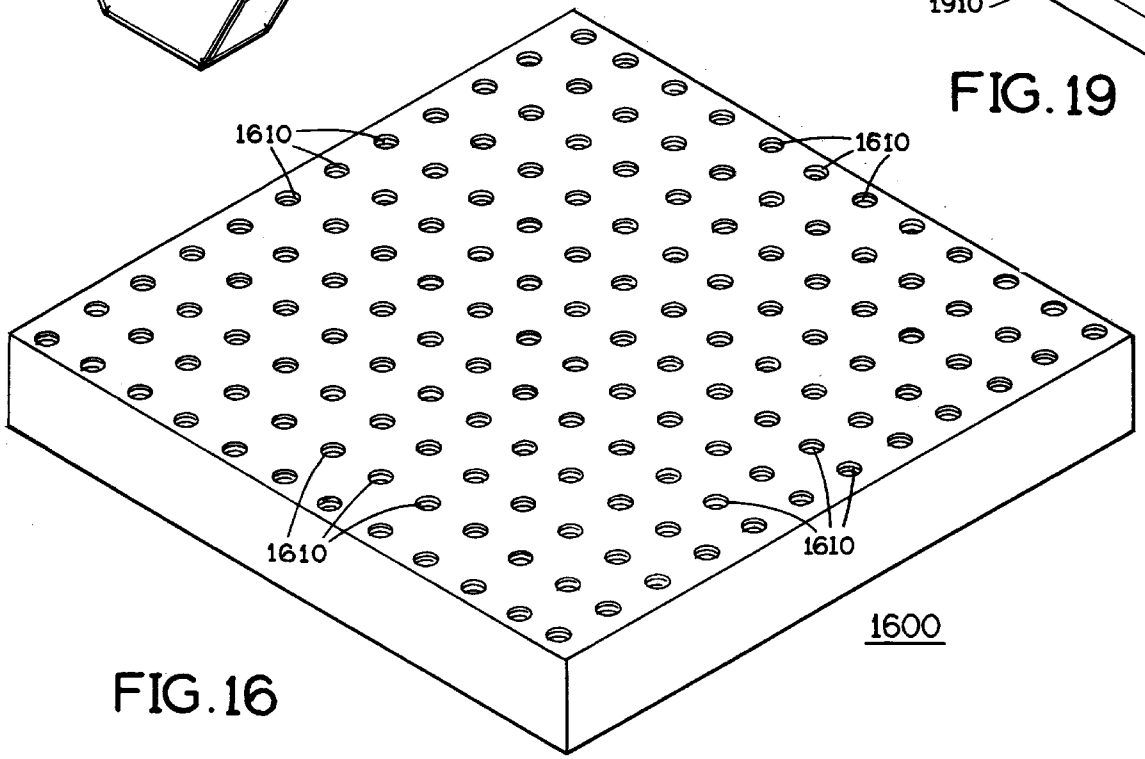
FIG. 16 is a perspective view of a mini-insert tray for use with the invention.

FIG. 16 is a perspective view of a mini-insert tray 1600 for use with the invention that includes mini-threaded openings 1610 that can mateable receive the mini threads 1710 of the mini threaded insert 1700 shown in FIG. 17. Note, that the smaller top surface 1718 of mini bolt 1700 can be used to grow micro-cultured coral. FIG. 18 is a version of the bolt 1200 of FIG. 12 with a threaded insert 1810 that can be used to mateably receive the threaded insert 1710 of FIG. 17. Bolt 1800 can be substituted for the Bolt of FIG. 12 and be used to grow micro cultured coral in the modules previously described. FIG. 19 is a perspective view of a center base plate 1900 that can receive the tray 1600 of FIG. 16. Center base plate 1900 includes an outer frame 1910 and nine(9) openings that are sized to receive each of the trays 1600 shown in FIG. 16.

Although, the blocks described above in the preferred embodiment have been described as square, the blocks can include other shapes such as but not limited to rectangular, circular, octagon and the like.

The object of the threaded inserts is to facilitate the mass micro propagation of selected varieties of corals, kelp, sponges and the like. These are grown initially at a very high density (up to 100 per square foot) under laboratory or protected conditions. When these micro cultures are securely established these mini inserts are then transferred and treated on larger (see FIG. 12) bolts at much lower densities (1–4 per square foot). These are allowed to grow until they are well established where they can then be attached to modules at density of 1 to 4 per module to reach maturity.

This is a major advance to the traditional practice of dropping construction type debris in the water and waiting to see what grows on it. Unfortunately, just as weeds grow faster than crops, undesired types of plant growth tend to colonize the fastest out competing the slower growing more desirable types. This system allows for high density, nursery/laboratory type cultivation of various desirable plant and animal species to mini treaded inserts which are then attached to larger bolt type inserts where they are grown until established enough to be inserted into their permanent home. What this will allow among other things, is the selection of the types (perhaps rare or endangered or perhaps native but in decline or perhaps economically or ecologically suited to specific applications). This can accelerate the time required for colonization. This will allow for controlled experimentation and research on various combinations including rare and endangered species.

A fair comparison of current practice and this novel invention would be like a farmer plowing and preparing his fields and then NOT planting what he wanted to grow, but waiting for the winds or birds or squirrels to drop seeds then waiting for them to grow before he knew what crop he had to harvest. This novel invention is a quantum leap forward for research, recreation and commercial applications. These selectively seeded inserts are to aqua culture what liners or seedlings are to plant nurseries. Large numbers of very small plants are grown under high density controlled conditions then put into larger containers (stepped up) for future field plantings. Micro culture of select species can enhance growth characteristics, disease resistance, pollution resistance and overall vigor. Mass micro propagation for aqua culture/marine culture is the equivalent of reforestation or reclamation of land. Germ plant seed banks can be established. Endangered species can be saved. Native growth can be restored. Marine reclamation can occur.

Specifically, this invention allows for the design and deployment of patch reefs to target needed enhancement of plant and animal species.

As a further analogy, considerable energy and funds have been allocated to the re-establishment of native plants on state and federal land. In the sea, little has been done to reseed native corals and marine plants. The loss of the native natural coral "forest" is well documented, but the specific "re-seeding" of declining species has not advanced significantly. Part of the reason is where and how. Natural reefs are protected and rightly so. So how can the colonization of specific species be accomplished. This novel invention provides both the how and the where. One of the greatest environmental impacts can be the re-establishment or, if you will, reforestation or reclamation of declining species.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An artificial reef structure of interlocking blocks for use in an underwater environment, the structure comprising:

a first hollow block having four substantially identical side walls connected together in a substantially block shape, each of the side-walls having grooves on both an upper side edge and on a lower side edge;

a second hollow block having four substantially identical side walls connected together in a substantially block shape, each of the side-walls having grooves on both an upper side edge and on a lower side edge, wherein the lower side edge grooves of the first hollow block interlock to certain side walls of the second hollow block;

a third hollow block having four substantially identical side walls connected together in a substantially block shape with each of the side-walls having grooves on both an upper edge and a lower side edge, wherein the lower side edge grooves of the first hollow block interlock to certain side edge grooves of the second hollow block, and said second and third blocks are separated horizontally from each other; and elastic support seat mounts for fitting in the grooves of the lower side edge grooves of the first hollow block.

2. The artificial reef structure of claim 1, wherein the elastic support seat mounts include:

rubber.

3. The artificial reef structure of claim 1, wherein the first block, the second block and the third block are formed from:

concrete.

4. The artificial reef structure of claim 1, further comprising:

a central planar support base plate within said first block having a circular opening therethrough.

5. The artificial reef structure of claim 1, further comprising:

a hollow dome supported on one of said blocks and having through-holes therethrough.

6. The artificial reef structure of claim 5, the hollow dome being preformed from:

concrete.

7. The artificial reef structure of claim 1, further comprising:

a rock insert in said first block.

8. The artificial reef structure of claim 7, further comprising:

a central base plate within said first block for supporting the rock insert.

9. The artificial reef structure of claim 1, further comprising:

a non-corrosive bolt through one of said blocks serving as a base for cultured coral.

10. The artificial reef structure of claim 9, further comprising:

a central base plate within said one block having a threaded opening for receiving the non-corrosive bolts.

* * * * *